US005379626A

United States Patent [19]

Hara et al.

[11] Patent Number: 5,379,626

[45] Date of Patent: Jan. 10, 1995

[54] METHOD OF FORMING A TAPPET BODY IN AN INTERNAL COMBUSTION ENGINE

[75] Inventors: Nobuo Hara, Fujisawa; Makoto Nagaya, Koza, both of Japan

[73] Assignee: Fuji Oozx, Inc., Kanaqawa, Japan

[21] Appl. No.: 127,807

[22] Filed: Sep. 28, 1993

[30] Foreign Application Priority Data

Oct. 12, 1992 [JP] Japan ..... 4-298167
Mar. 23, 1993 [JP] Japan ..... 5-86946

[51] Int. Cl.[6] ..... B21K 1/20
[52] U.S. Cl. ..... 72/356; 29/888.43
[58] Field of Search ..... 29/888.43; 72/256, 267, 72/356, 377

[56] References Cited

U.S. PATENT DOCUMENTS 1,082,200 12/1913 Knaebel ..... 72/267
4,291,568 9/1981 Stifano, Jr. ..... 72/356
4,847,968 7/1989 Shirai et al. ..... 72/356

OTHER PUBLICATIONS

Society of Automotive Engineers "Aluminum Valve Lifter for Toyota New V-8 Engine", Paper No. 900450, approximately 2/26 or 3/2, 1990.

*Primary Examiner*—Lowell A. Larson
*Attorney, Agent, or Firm*—Zarley, McKee, Thomte, Voorhees & Sease

[57] ABSTRACT

To manufacture an Al alloy tappet in an internal combustion engine, an intermediate which has a circular upper wall and a cylindrical skirt is formed in the first forging step. In the second forging step, a recess is formed on the lower surface of the upper wall. Relatively large-sized metallic structure in the first forging step is finally collapsed, thereby increasing strength and rigidity of the upper wall around the recess.

2 Claims, 6 Drawing Sheets

METHOD OF FORMING A TAPPET BODY IN AN INTERNAL COMBUSTION ENGINE

BACKGROUND OF THE INVENTION

This invention relates to a method of forming a tappet body for use in a direct acting type valve operating mechanism in an internal combustion engine.

Recently aluminium alloy tappets (valve lifters) have been used in a direct acting type valve operating mechanism of DOHC type to provide a lighter valve mechanism, thereby increasing engine capability. Al alloy tappets have lower strength, rigidity and wear resistance compared with steel tappets, and wear resistant metal is applied to the surfaces which contact a rotary cam and an engine valve.

Such Al alloy tappets are illustrated in FIG. 6. A tappet "A" comprises a substantially circular upper wall 1; a substantially cylindrical skirt 2 which extends from the circumference of the upper wall 1; and a cylindrical shim receiving portion 3 which extends on the circumference of the upper wall 1 to constitute an Al alloy tappet body 4. With the shim receiving portion 4 is engaged a circular outer shim 5 made of wear resistant matel. The tappet body 4 is engaged with a rotary cam 6 via the outer shim 5, and a circular shim 8 made of wear resistant metal is engaged with a recess 7 in the middle of an inversed frustoconical thickened portion la on the lower surface of the upper wall 1. The tappet body 4 is engaged with the axial end of an engine valve 9 via the inner shim 8.

Conventionally, to form the tappet body 4, as shown in FIG. 7, there is provided a counter punch 113 the upper end of which fits the lower surface of the finished tappet body 4 at the bottom of a guide bore 112 of a die 111. On the counter punch 113, Al alloy cylindrical material 114 is placed, and a punch 115 the lower end of which fits the upper surface of the finished tappet body comes down, thereby forming a tappet by a single step of cold forging.

In the tappet for use in a direct acting type valve operating mechanism, the inner shim 8 directly contacts the engine valve 9, so that the recess 7 in which the inner shim 8 fits is repeatedly subjected to large compression stress. Accordingly, the thickened portion la around the recess 7 requires high strength and rigidity. However, when the recess 7 is integrally molded with the thickened portion 1*a* once, a relatively large flow "B" is formed in the thickened portion 1*a* around the recess 7 as shown in FIG. 8, so that metallic structure (crystal) around the recess 7 becomes more coarse, thereby providing poor strength and rigidity against compression load and sideward pressure. Further, the thickened portion la around the recess 7 mechanically formed becomes rough laminate structure, which is inconvenient against compression stress and sideward pressure. When rigidity around the recess 7 is low as above, the recess 7 is deformed to cause a play with the inner shim 8, thereby decreasing holding force to the inner shim 8 and increasing a gap to generate noise.

In the known method as above, the shim receiving portion 3 is too short compared with the skirt 2, so that the punch 115 contacts the material 114 and forming of the shim receiving portion 3 terminates when deformation of the material 14 begins. The material extruded by descent of the punch 115 all flows towards the skirt 2, and as shown in FIG. 9, at a branched portion of the skirt 2 and the shim receiving portion 3 in the upper wall 1, there is formed a boundary "E" between a flow-stopping portion "C" and a skirt-directing portion "D". Flow separation is liable to occur, thereby decreasing strength and, at worst, generating cracks. To prevent such flow separation, forward and backward extrusion without restricting the ends of the skirt 2 and the shim receiving portion 3 has been suggested, but the shim receiving portion 3 is too long, thereby increasing mechanical working cost and thus decreasing material efficiency or yield.

In view of the disadvantages in the prior art, the object of the present invention is to provide a method of forming a tappet body in an internal combustion engine in which metallic structure becomes condensed to increase strength, rigidity and yield by improving flow in the material to be formed during forging.

SUMMARY OF THE INVENTION

According to one aspect of the present invention, there is provided a method of forming a tappet body in an internal combustion engine, the method comprising the steps of forming an intermediate which comprises a circular upper wall and a cylindrical skirt integrally formed with the upper wall from plastically deformable material in the first forging; and forming a recess in the middle of said upper wall in the second forging to make the tappet body.

According to another aspect of the present invention, there is provided a method of forming a tappet body in an internal combustion engine, the method comprising the steps of forming an intermediate which comprises an upper wall and a skirt which suspends from the circumference of the upper wall from plastically deformable material in the first forging; and extruding the upper wall of the intermediate forwardly and backwardly to extend the skirt downwardly and the shim receiving portion upwardly in the second forging to make the tappet body.

According to further aspect of the present invention, there is provided a method of forming a tappet body in an internal combustion engine, the method comprising the steps of forming an intermediate which comprises a thick upper wall and a short skirt which suspends from the circumference of the upper wall by extruding the upper wall forwardly in the first forging; and extruding the upper wall of the intermediate forward and backward to form a recess at the lower surface of the upper wall and extend the skirt downwardly and the shim receiving portion upwardly in the second forging to make the tappet body.

When the recess is formed in the second forging step, relatively large-sized metallic structure formed in the first forging step is collapsed to form condensed structure in the surface layer of the recess, thereby increasing strength and rigidity and holding a tip stably. All the material in the upper wall extruded in the first forging step flows to the skirt (forward extrusion) to form laminate flow having little disorder. Then, in the second forging step, the meterial extruded from the upper wall flows to the skirt and the shim receiving portion smoothly (forward and backward extrusion), and the forging stops as soon as the forming of the shim receiving portion finishes, thereby improving flow at a branched portion of the upper wall, the skirt and the shim receiving portion to prevent occurrence of boundary which causes flow separation and condense the metallic structure of the branched portion to increase strength and rigidity.

Almost the skirt is formed by forward extrusion in the first forging step, and the shim receiving portion is formed by backward extrusion while the skirt is extended by forward extrusion in the second forging step, whereby the shim receiving portion and the skirt is formed at a desired length. Thus, working cost after forging is minimized and yield is increased.

BRIEF DESCRIPTION OF THE DRAWINGS

The above and other features and advantages of the present invention will become clear by the following description with respect to appended drawings wherein.

DETAILED DESCRIPTION OF PREFERRED EMBODIMENTS

Figure 1A:
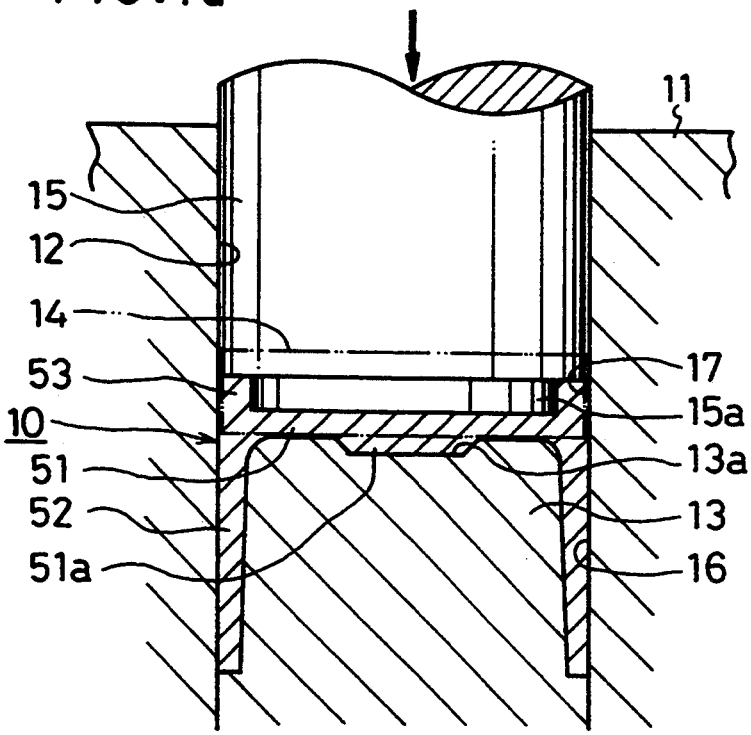
FIG. 1*a* is a central sectional front view which illustrates the first forging step of the first embodiment of a method of forming a tappet body according to the present invention.

In FIG. 1*a*, 11 denotes a die of a cold press device; 12 denotes a circular guide bore in the die 11; and 13 denotes a counter punch fixed to the die 11 at the bottom of the guide bore 12. The upper surface of the counter punch 13 fits the lower surface of an upper wall 1 on which there is provided a thickened portion la without a recess 7 of a finished tappet body 4 in FIG. 6. 13*a* denotes a recess at the upper surface of the counter punch 12 to form the thickened portion 1*a* of the upper wall 1.

The numeral 14 denotes a spreadable Al alloy cylindrical material, and 15 denotes a punch the lower surface of which fits the upper surface of the finished tappet body 4. The lower surface has a smaller diameter portion 15*a* for forming an outer shim engaging portion, and the punch 15 can go up and down in close contact with the guide bore 12 of the die 11. 16 denotes a gap between the circumference of the counter punch 13 and the inner surface of the guide bore 12, and 17 denotes a gap between the inner surface of the guide bore 12 and the circumference of the smaller diameter portion 15*a*.

In the first embodiment, with a device as shown in FIG. 1*a*, material 14 is put on the counter punch 13, and then the punch 15 lowers to perform the first forging.

The material 14 is plastically deformed and invaded into the gap 16 and the recess 13*a*, thereby forming an intermediate 10 which comprises a skirt 52 in the gap 16; a shim receiving portion 53 in the gap 17; an upper wall 51 in the gap between the upper surface of the counter punch 13 and the lower surface of the smaller diameter portion 15*a* of the punch 15; and a thickened portion 1*a'* in the recess 13*a*.

Figure 1B:
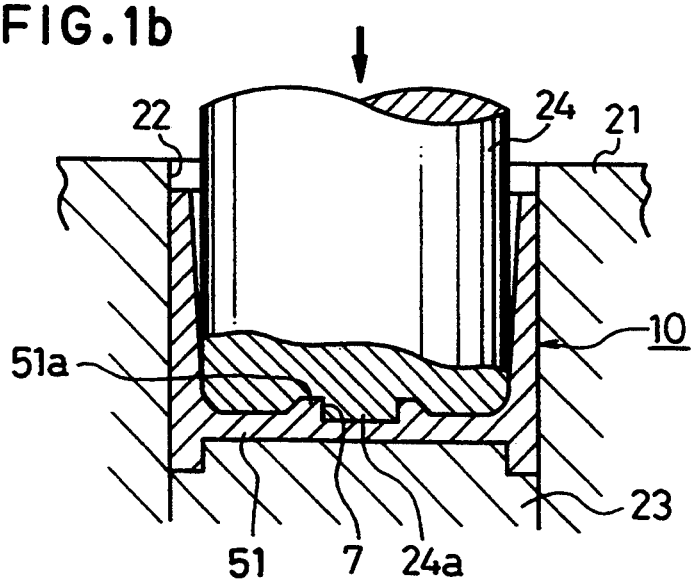
FIG. 1*b* is a central sectional front view which illustrates the second forging step of the first embodiment.
Figure 6:
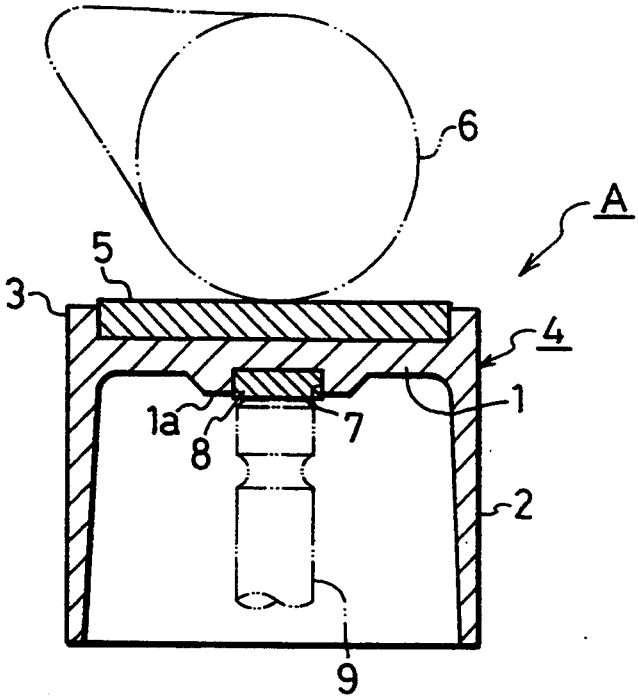
FIG. 6 PRIOR ART
FIG. 6 is a central longitudinal sectional front view which illustrates a tappet which is employed in a direct acting type valve operating mechanism.
Figure 7:
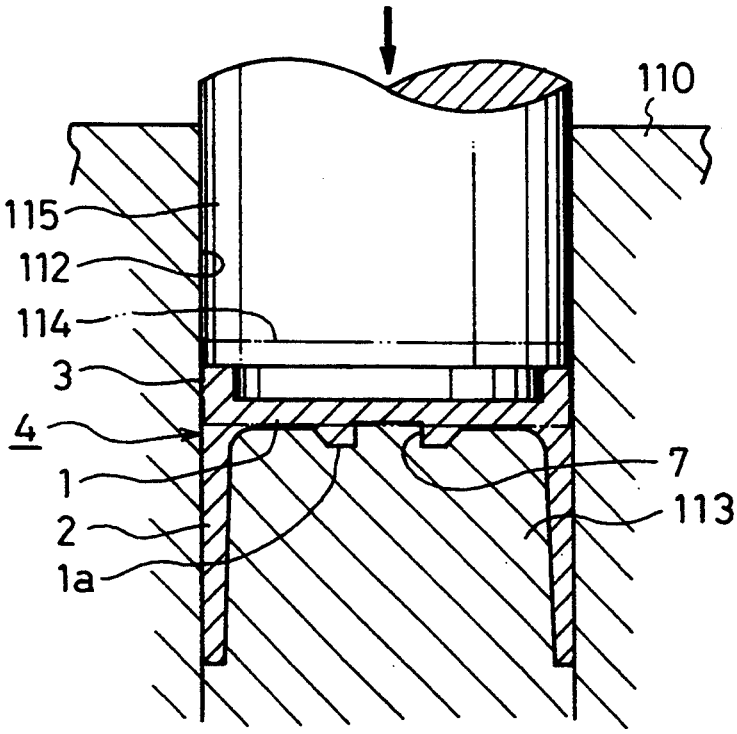
FIG. 7 PRIOR ART
FIG. 7 is a central longitudinal sectional front view which illustrates a known method of forming a tappet body.
Figure 8:
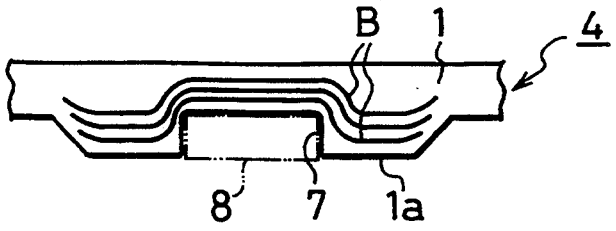
FIG. 8 is a view which illustrates how material flows around a recess in the known tappet body.

Then, in another press as shown in FIG. 1*b*, the intermediate 10 is inversely disposed and subjected to the second forging step. The press in FIG. 1*b* comprises a die 21 of a cold press; a counter punch 23 fixed to the die 21 at the bottom of a circular guide bore 22 in the die 21, the upper surface of the counter punch 23 fitting the upper surface of the tappet body 4 as shown in FIG. 6; and a punch 24 which has a downward projection 24*a* for forming a recess 7 into which the inner shim 8 fits.

In the second forging step, the intermediate 10 is inverted in the guide bore 22 of the die 21 and the punch 24 is lowered. The projection 24*a* of the punch 24 presses tile upper surface of the thickened portion 51*a* of the upper wall 51 of the intermediate 10, thereby causing plastic deformation of the thickend portion 51*a* to form the recess 7 in which the inner shim 8 fits and make a tappet body finally.

Figure 2:
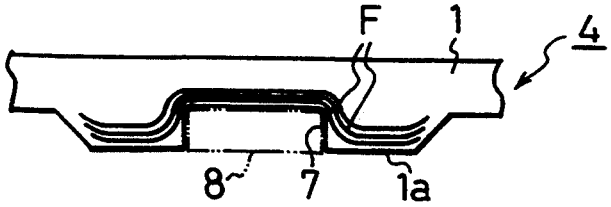
FIG. 2 is a view which illustrates how material flows around a recess in the first embodiment.

In the first forging step, the intermediate 10 which comprises the upper wall 51 having the thickened portion 51*a*, the skirt 52 and the shim receiving portion 53 is formed; and in the second forging step, the recess 7 formed in the thickened portion 51*a* is formed, so that condensed flow "F" is made by pressing and destroying large-sized metallic structure when the recess 7 is formed in the second forging step as shown in FIG. 2, which is different from a known example in which only relatively large-sized flow is made at the thickened portion la around the recess 7 by a single forging step. Accordingly, the structure around the recess 7 is condensed to increase strength and rigidity of the thickened portion around the recess 7, and the inner shim 8 is firmly held in the recess 7. In the first embodiment, the recess 7 is formed in the middle of the thickened portion of the upper wall 1, but may be formed directly on all the thick upper wall 1 without the thickened portion 1*a*.

Figure 3A:
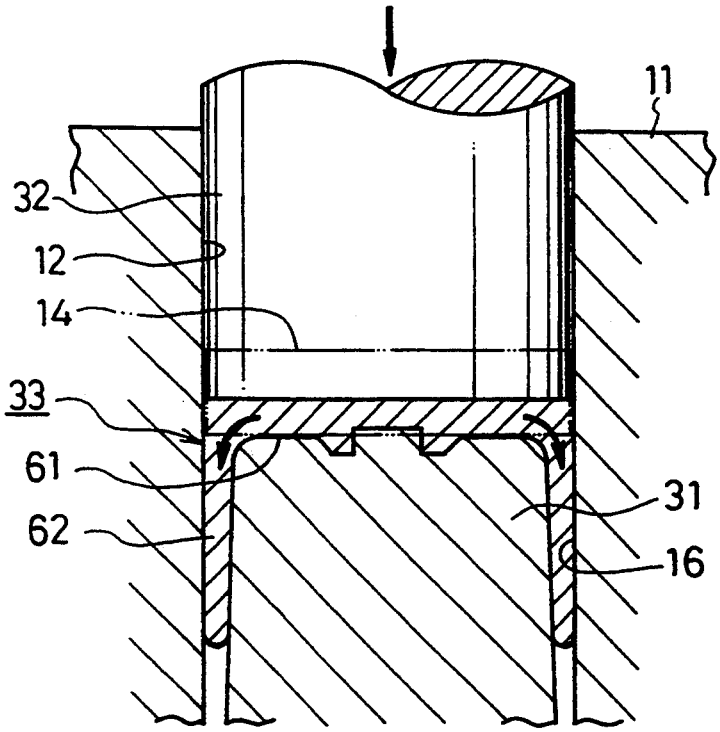
FIG. 3*a* is a central longitudinal sectional front view which illustrates the first forging step of the second embodiment.

FIG. 3 illustrates the second embodiment in which the same numerals are assigned to the same parts and members as those in the first embodiment, and the detailed description thereof is omitted. In FIG. 3*a*, 31 denotes a counter punch the upper surface of which fits the lower surface of the finished tappet body 4; and 32 denotes a punch which has an outer diameter which is substantially equal to the inner diameter of the guide bore 12 of the die 11, the lower surface of the punch having a circular flat surface. Between the outer circumference of the counter punch 31 and the inner surface of the guide bore 11, the gap 16 is longer than the skirt 2 of the finished tappet body 4, and the counter punch 31 is fixed to the die 11. In the second embodiment, after the material 14 is placed on the counter punch 31 as shown in FIG. 3*a*, the punch 32 lowers in the first forging step. The material 14 is pressed between the punch 32 and the counter punch 31 and circumferentially invaded into the gap 16, so that it is subject to plastic deformation, thereby forming an intermediate tappet body 33 which comprises a skirt 62 which is invaded in the gap 16 and an upper wall 61 between the punches 31 and 32. Flow in the material 14 is limited only to a gap-invading direction as shown in FIG. 3*a*, so that flow disorder is very little at a corner between the upper wall 61 and the skirt 62 and laminar flow is made. Then, as shown in Fig, 3*b*, while holding the intermediate 33 on the counter punch 31 in the guide bore 12 of the die 11, the second forging step is carried out by replacing only the punch 32 with the punch 34 which has a smaller diameter portion 34*a* for forming an outer shim engaging portion at the lower surface. The material extruded out of the upper wall 61 flows into both the gap 16 and the gap 17 which is formed between the inner surface of the guide bore 12 of the die 11 and the outer circumference of the smaller diameter portion 34*a*. (forward and backward extrusion)

The ratio of the material which flows into the gap 17 in backward extrusion is larger than the ratio of the material which flows into the gap 16 in forward extrusion. Thus, the length of the skirt 62 of the intermediate 33 formed by the first forging step is previously made to be substantially equal to that of the skirt 2 of the finished tappet body 4, and by slight flow into the gap 16 in the second forging step, the length of the skirt may preferably become equal to that of the skirt 2 of the finished tappet body 4.

Figure 4:
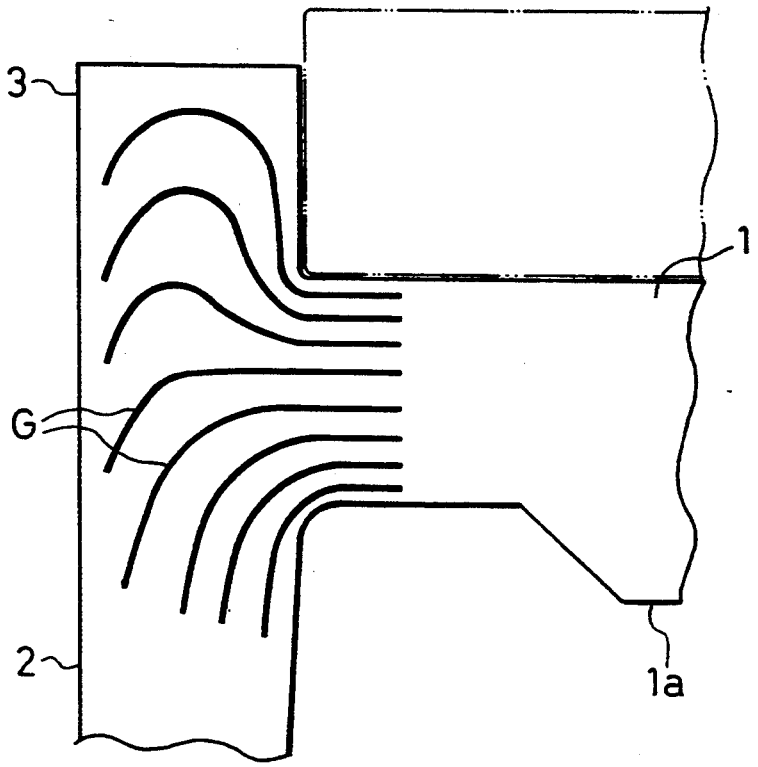
FIG. 4 is a view which illustrates how material flows around a recess formed in the second forging step the second embodiment.
Figure 9:
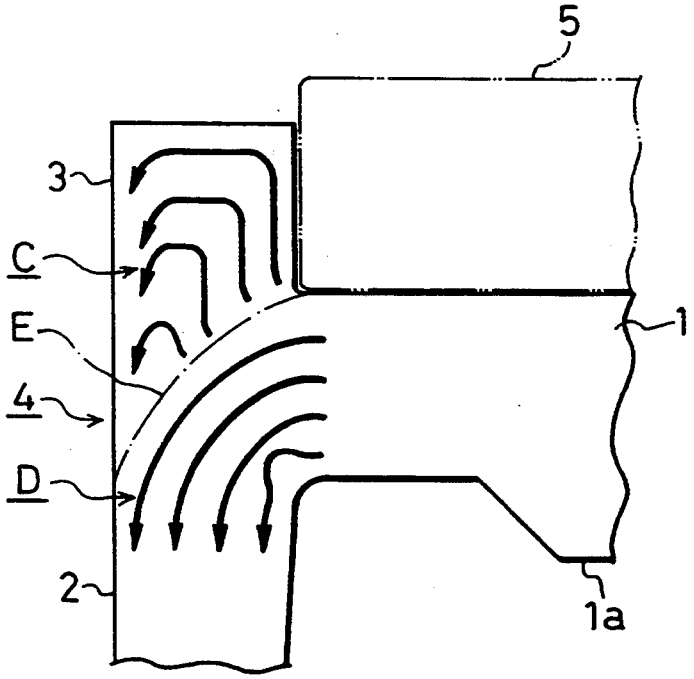
FIG. 9 is a view which illustrates how the material flows at a branched portion of the upper wall, a skirt and a shim receiving portion in the known tappet body.

When the gaps 16 and 17 are filled with the material, the press stops, and the tappet body 4 is formed such that the flow "G" at a branched portion of the upper wall 1, the skirt 2 and the shim receiving portion 3 smoothly moves from the upper wall 1 to the skirt 2 and the shim receiving portion 3, as shown in FIG. 4. In the tappet body 4 thus formed, the flow "G" at the branched portion of the upper wall, the skirt 2 and the shim receiving portion 3 is smooth, thereby avoiding flow separation, strength decreasing and cracking without the boundary "E" as shown in FIG. 9 in the known device.

Further, in the second embodiment, during the first forging step, the material 14 is forwardly extruded to form the skirt 62 of the intermediate 33, thereby providing good alignment of the inner diameter to the outer diameter of the skirt 62 and reducing cost for mechanial working after forging. That is to say, when the skirt 62 of the intermediate 33 is formed by backward extrusion, the material readily flows, but the alignment of the inner diameter to the outer diameter of the skirt 62 becomes worse. However, in the first forging step of the second embodiment, the counter punch 31 is fixed to the guide bore 12 of the die 11, thereby providing better alignment. In the second embodiment, the counter punch 31 is used in both the first and second forging steps, and the second forging step can be made without releasing the intermediate 33 formed by the first forging step from the die 11, thereby increasing working efficiency.

Figure 5A:
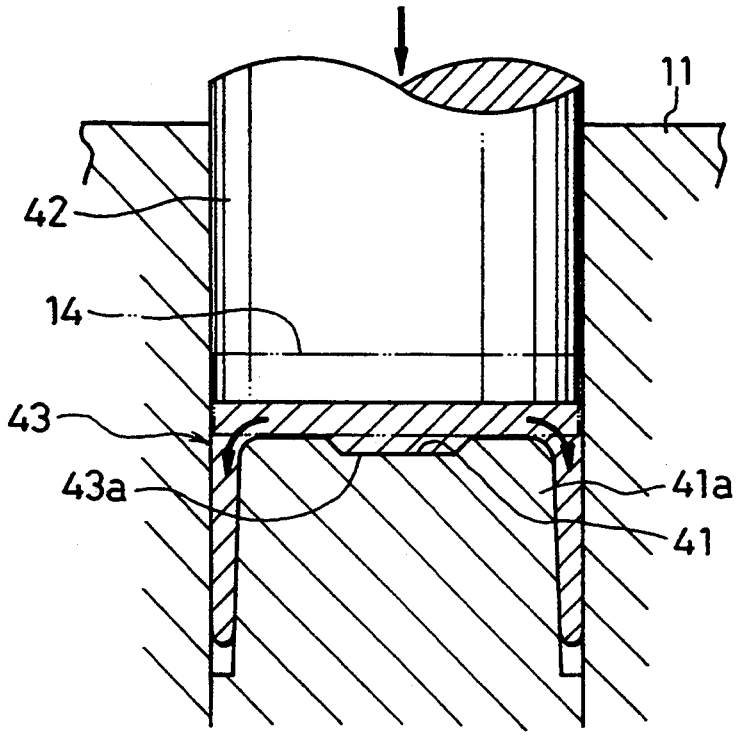
FIG. 5*a* is a central longitudinal sectional front view which illustrates the first forging step of the third embodiment.

FIG. 5*a* illustrates the third embodiment of the present invention. 41 denotes a counter punch which is the same as the counter punch 13 in FIG. 1*a* and has a recess 41*a* for forming the thickened portion 1*a* of the upper wall 1, similar to the recess 13*a*, at the upper surface. 42 denotes a punch which is the same as the punch 32 in FIG. 3*a* and has a circular flat lower surface. In the third embodiment, after the material 14 is placed on the counter punch 41, the punch 42 is lowered and the first forging step is carried out. Thus, there is formed an intermediate 43 which has a lower surface having a thickned portion 43*a* the same as the lower surface of the intermediate 10 in FIG. 1*a* and which has a flat upper surface the same as the upper surface of the intermediate 33 in FIG. 3*a*.

Figure 3B:
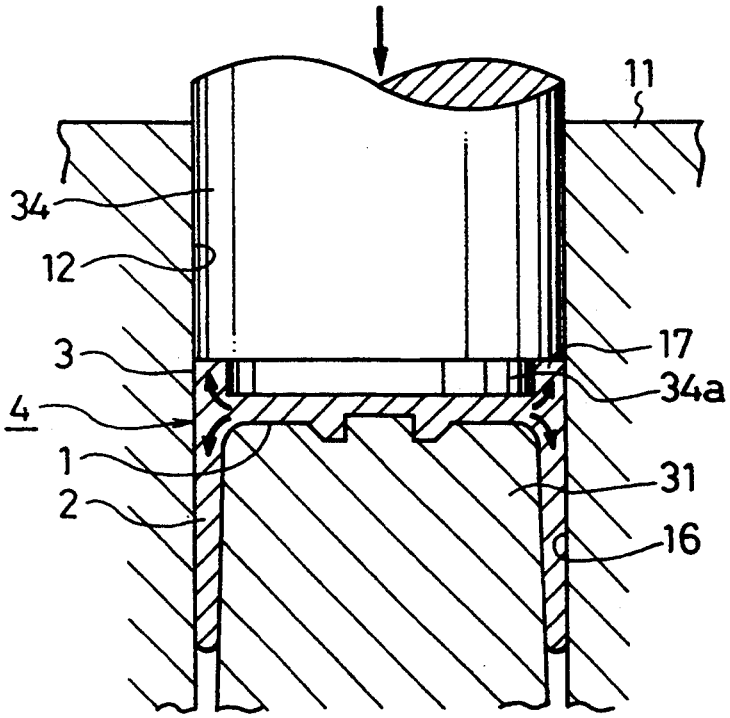
FIG. 3*b* is a central longitudinal sectional front view which illustrates the second forging step of the second embodiment.
Figure 5B:
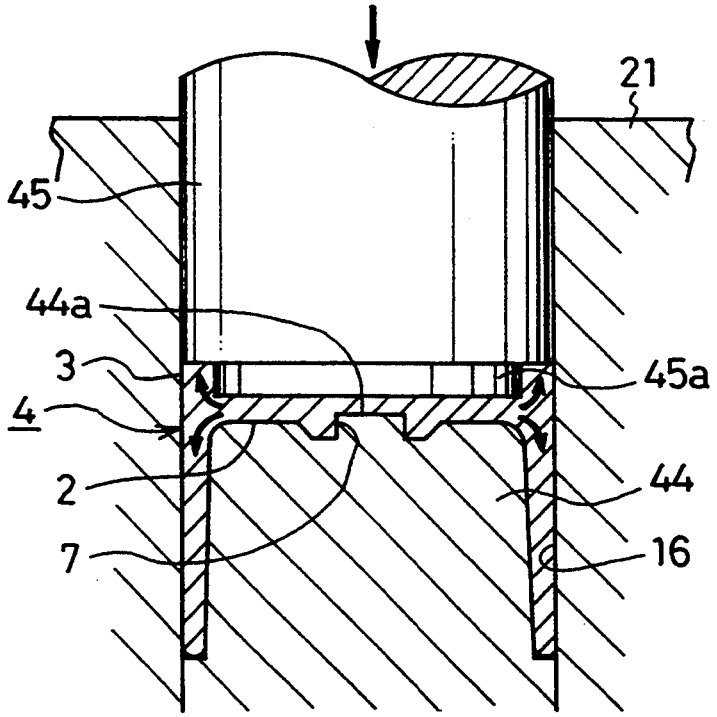
FIG. 5*b* is a central longitudinal sectional front view which illustrates the second forging step of the third embodiment.

Then, after the intermediate 43 is placed on a counter punch 44 the same as the counter punch 31 in FIG. 3*b*, as shown in FIG. 5*b*, a punch 45 the same as the punch 34 is lowered and the second forging step is carried out. A projection 44*a* in the middle of a counter punch 44 forms a recess 7 for engaging an inner shim on the lower surface of the intermediate 43. A smaller diameter portion 45*a* of the punch 45 forms a shim receiving portion 3 for engaging an outer shim on the upper surface of the intermediate 43 and a gap 16 forms a skirt 3 to make a tappet body 4.

In the third embodiment, the first forging step forms the thickened portion 43*a* on the intermediate 43, and, then, the second forging step forms the recess 7 on the thickened portion 43*a*, thereby attaining the same advantages as those in the first embodiment. Further, the first forging step forms the intermediate 43 which has a flat upper surface, and, then, the second forging step forms the shim receiving portion 3 by pressing the smaller diameter portion 45*a* of the punch 45 onto the upper surface, thereby attaining the same advantages as that in the second embodiment. The third embodiment can attain the same advantages as those attained by both the first and second embodiments.

The foregoings merely relate to embodiments of the invention. Any changes and modifications may be carried out by person skilled in the art without departing from the scope of the following claims wherein:

What is claimed is:

1. A method of forming a tappet body in an internal combustion engine, the method comprising the steps of:

forming an intermediate which comprises a circular upper wall having a thickened portion in the middle of a lower surface thereof, and a cylindrical skirt integrally formed with the upper wall from plastically deformable material in a first forging; and forming a recess in the thickened portion of the upper wall in a second forging to make the tappet body.

2. A method of forming a tappet body in an internal combustion engine, the method comprising the steps of:

forming an intermediate which comprises an upper wall having a thickened portion which projects downwardly, and a short skirt which suspends from a circumference of the upper wall by extruding the upper wall forwardly in a first forging; and extruding the upper wall of the intermediate forwardly and backwardly to form a recess on the thickened portion of the upper wall and a shim receiving portion upwardly and to extend the skirt downwardly in a second forging while restricting a backward extrusion end of the shim receiving portion within a predetermined distance from the upper wall to make the tappet body.

* * * * *